US011105025B2

(12) United States Patent
Boylu et al.

(10) Patent No.: US 11,105,025 B2
(45) Date of Patent: Aug. 31, 2021

(54) SPACER TEXTILE HAVING TIE YARNS OF ONE OR MORE LENGTHS

(71) Applicant: NIKE, Inc., Beaverton, OR (US)

(72) Inventors: Hasan Boylu, Portland, OR (US); Richa Maheshwari, Boston, MA (US); Payton Rose, Beaverton, OR (US); Heidi A. Vaughan, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 270 days.

(21) Appl. No.: 16/363,318

(22) Filed: Mar. 25, 2019

(65) Prior Publication Data

US 2019/0368087 A1 Dec. 5, 2019

Related U.S. Application Data

(60) Provisional application No. 62/677,359, filed on May 29, 2018.

(51) Int. Cl.

| | |
|---|---|
| ***D04B 21/04*** | (2006.01) |
| ***D04B 1/24*** | (2006.01) |
| ***D04B 1/16*** | (2006.01) |
| ***D04B 1/04*** | (2006.01) |
| ***D04B 21/20*** | (2006.01) |

(52) U.S. Cl.

CPC ..... *D04B 21/04* (2013.01); *D04B 1/04* (2013.01); *D04B 1/16* (2013.01); *D04B 1/24* (2013.01); *D04B 21/207* (2013.01); *D10B 2331/02* (2013.01); *D10B 2331/04* (2013.01); *D10B 2501/00* (2013.01)

(58) Field of Classification Search

CPC . D04B 21/04; D04B 1/04; D04B 1/16; D04B 1/24; D04B 21/207

See application file for complete search history.

(56) References Cited

U.S. PATENT DOCUMENTS

| | | | | |
|---|---|---|---|---|
| 3,874,958 A | | 4/1975 | Scholtis et al. | |
| 4,113,432 A | | 9/1978 | Otto | |
| 4,417,897 A | | 11/1983 | Stahl et al. | |
| 5,385,036 A | * | 1/1995 | Spillane | A43B 1/04 2/16 |
| 5,589,245 A | | 12/1996 | Roell | |

(Continued)

FOREIGN PATENT DOCUMENTS

| | | |
|---|---|---|
| CN | 103362005 A | 10/2013 |
| CN | 103774472 B | 1/2016 |

(Continued)

OTHER PUBLICATIONS

"Air Mesh Fabrics: Spacer Fabric," Chaitanya Impexx, canvasfabric.in, May 25, 2012. https://web.archive.org/web/20120525060719/http://www.canvasfabric.in/air-mesh-fabrics.html.

(Continued)

*Primary Examiner* — Danny Worrell

(74) *Attorney, Agent, or Firm* — Shook, Hardy & Bacon LLP

(57) ABSTRACT

Aspects herein are directed to a spacer textile comprising a first layer, a second layer, and a plurality of tie yarns that interconnect the first layer and the second layer. The spacer textile further comprises one or more discrete areas from which the first layer is absent along with a portion of the length of the tie yarns in those areas.

20 Claims, 11 Drawing Sheets

(56) References Cited

U.S. PATENT DOCUMENTS

| | | | | |
|---|---|---|---|---|
| 6,037,035 | A | 3/2000 | Boettger | |
| 6,156,406 | A * | 12/2000 | Rock | B32B 5/12 428/86 |
| 6,196,032 | B1 | 3/2001 | Rock et al. | |
| 6,755,052 | B1 * | 6/2004 | Sytz | D04B 1/18 66/19 |
| 6,837,078 | B1 | 1/2005 | Rock et al. | |
| 7,380,420 | B1 * | 6/2008 | Liu | D04B 21/18 66/195 |
| 7,426,840 | B2 | 9/2008 | Sytz | |
| 7,435,264 | B2 | 10/2008 | Kiff | |
| 7,565,821 | B2 * | 7/2009 | Park | B60N 2/976 66/195 |
| 7,913,520 | B1 * | 3/2011 | Chen | D04B 1/16 66/196 |
| 8,719,962 | B1 | 5/2014 | Huff | |
| 8,808,556 | B2 | 8/2014 | Kukoff | |
| 8,904,829 | B2 | 12/2014 | Keitch | |
| 9,458,568 | B2 | 10/2016 | Jia et al. | |
| 9,574,301 | B2 | 2/2017 | Kitamura | |
| 9,677,209 | B2 * | 6/2017 | Daube | D04B 21/20 |
| 2002/0104335 | A1 | 8/2002 | Shirasaki et al. | |
| 2007/0212959 | A1 | 9/2007 | Johnson | |
| 2008/0209638 | A1 | 9/2008 | Unger | |
| 2009/0061173 | A1 | 3/2009 | Liao et al. | |
| 2012/0260422 | A1 | 10/2012 | Rock et al. | |
| 2013/0298317 | A1 | 11/2013 | Fonte et al. | |
| 2015/0104604 | A1 * | 4/2015 | Rock | B32B 5/026 428/86 |
| 2015/0240030 | A1 * | 8/2015 | Kulkarni et al. | |

FOREIGN PATENT DOCUMENTS

| | | | |
|---|---|---|---|
| CN | 103774471 | B | 6/2016 |
| DE | 4109263 | A1 | 9/1992 |
| DE | 19602833 | A1 | 8/1997 |
| DE | 102007061132 | A1 | 6/2009 |
| EP | 1905889 | A2 | 4/2008 |
| EP | 2261408 | A1 | 12/2010 |
| WO | 2007086593 | A1 | 8/2007 |

OTHER PUBLICATIONS

"Product groups: Knitted Spacer Fabric," Averinox, averinox.nl, 2011. http://www.averinox.nl/knitted_spacer_fabric.html.

"Navy Blue Diva Diamond Elegant burn out diamond velvet Fabric by the yard," Etsy, etsy.com, accessed: Jun. 2017. https://www.etsy.com/listing/496412957/navy-blue-diva-diamond-elegant-burn-out.

"Burnout & Lasercut Fabric," Mood, moodfabrics.com, accessed: Jun. 2017. https://www.moodfabrics.com/fashion-fabrics/other-fabrics/burnout-lasercut.

International Preliminary Report on Patentability received for PCT Patent Application No. PCT/US2019/024547, dated Dec. 10, 2020, 8 pages.

International Search Report and Written Opinion dated Jul. 10, 2019 in International Patent Application No. PCT/US2019/024547, 14 pages.

* cited by examiner

SPACER TEXTILE HAVING TIE YARNS OF ONE OR MORE LENGTHS

CROSS-REFERENCE TO RELATED APPLICATIONS

This application, assigned U.S. application Ser. No. 16/363,318, filed Mar. 25, 2019, and entitled "Spacer Textile Having Tie Yarns of One or More Lengths," claims the benefit of priority to U.S. Prov. App. No. 62/677,359, entitled "Spacer Textile Having Tie Yarns of One or More Lengths," and filed May 29, 2018. The entirety of the aforementioned application is incorporated by reference herein.

TECHNICAL FIELD

Aspects herein related to an integral, three-dimensional spacer textile having tie yarns of one or more lengths.

BACKGROUND

Traditional spacer textiles comprise two layers of textiles joined together by tie yarns that are interlooped with yarns in the textile layers.

DESCRIPTION OF THE DRAWINGS

Examples of aspects herein are described in detail below with reference to the attached drawing figures, wherein.

DETAILED DESCRIPTION

Figure 1:
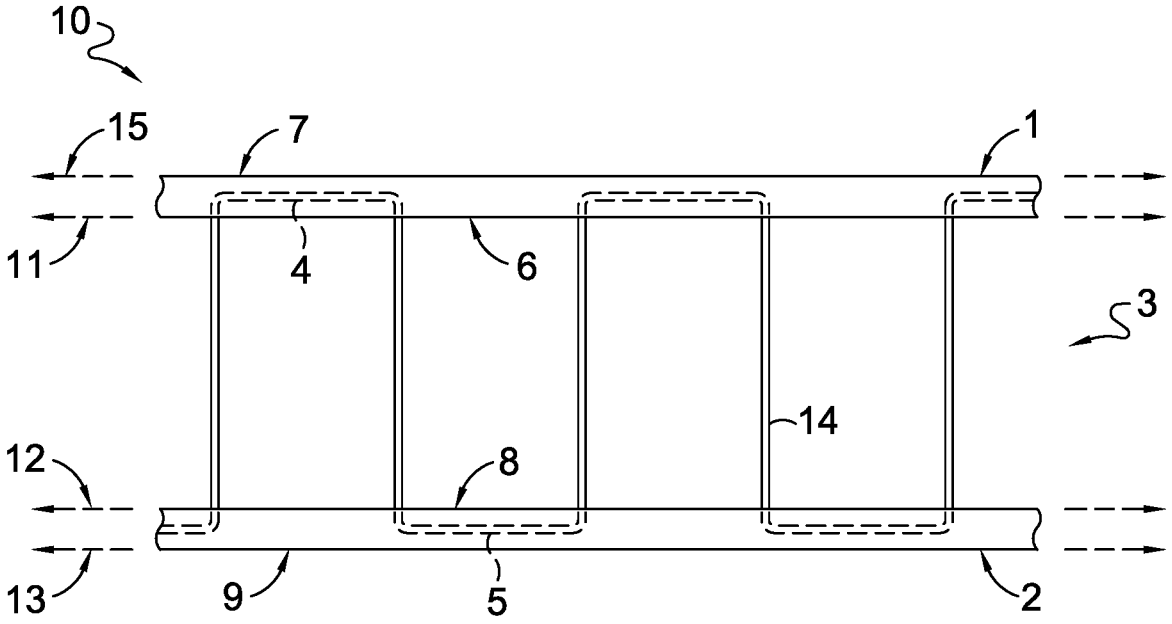
FIG. 1 illustrates a cross-section view of a spacer textile to illustrate common structural features of knit spacer textiles in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein relate to a textile and garments formed from the textile. In one aspect, the textile comprises a three-dimensional (3-D) spacer textile with a first area having a first layer comprising, for instance, a mesh construction with integrally formed holes, a second layer comprising, for instance, a continuous knit construction, and a third layer that interconnects the first layer and the second layer. In aspects, the third layer comprises one or more multifilament tie yarns (also known as spacer yarns) that interconnect the first layer and the second layer. The textile further comprises at least a second area in which the first layer is absent or removed along with differing length portions of the tie yarns. The result is a textile that has the aesthetic and function of a plush or velour type textile having different length piles at the second area while the remaining areas of the textile have the aesthetic and function of a spacer textile.

In another aspect, the textile comprises a 3-D spacer textile with a first area having a first layer comprising, for instance, a continuous knit construction knit using a fine denier (from about 20 denier to about 24 denier) yarn type, a second layer comprising, for instance, a continuous knit construction, and a third layer that interconnects the first layer and the second layer. In aspects, the third layer comprises one or more monofilament tie yarns that interconnect the first layer and the second layer. The textile further comprises at least a second area in which the first layer is absent or removed along with the monofilament tie yarns located in the second area. The result is a textile that comprises just the second layer at the second area while the remaining areas of the textile have the aesthetic and the function of a spacer textile.

In yet another aspect, the textile comprises a 3-D spacer textile with a first area having a first layer comprising, for instance, a continuous knit construction knit using a fine denier (from about 20 denier to about 24 denier) yarn type, a second layer comprising, for instance, a continuous knit construction, and a third layer that interconnects the first layer and the second layer. In aspects, the third layer comprises one or more multifilament tie yarns that interconnect the first layer and the second layer. The textile further comprises at least a second area in which the first layer is absent or removed along with the "loop" portion of the tie yarns located in the second area. The result is a textile that has the aesthetic and function of a plush or velour type textile having a generally uniform pile length at the second area while the remaining areas of the textile have the aesthetic and function of a spacer textile.

Continuing, from a functional perspective, areas of the textile comprising the first layer, the second layer, and the third layer exhibit properties generally associated with spacer textiles such as cushioning properties, insulation (e.g., heated air is trapped or stored in the space between the first layer and the second layer), thermoregulation, and a level of air permeability that is generally greater than typical knit constructions such as single jersey or double jersey knits. The second areas described herein (e.g., areas at which the first layer and the tie yarns, or a portion of the length of the tie yarns, are absent or removed) generally exhibit a higher degree of air permeability as compared to areas of the textile comprising the first layer, the second layer, and the third layer. When the textile is incorporated into a garment, the second areas described herein may be positioned on the garment to correspond to high heat or sweat producing areas of the human body when the garment is in an as-worn configuration. Because these areas exhibit a higher degree of air permeability as compared to remaining portions of the textile, air from the external environment may more easily enter the garment at these areas thereby helping to cool the wearer, and heat and/or moisture vapor produced by the wearer may more easily escape the garment in these areas.

Aspects herein are further directed to a method of forming a textile having the properties described above. In aspects, the method may comprise applying an alkaline fiber-decomposing agent to a textile comprising a first layer formed from one or more cationic dyeable polyethylene terephthalate (CD PET) yarns, a second layer formed from non-CD PET yarns, and a third layer comprising one or more multifilament or monofilament CD PET yarns that interconnect the first layer and the second layer. More particularly, the alkaline fiber-decomposing agent is applied to the first layer of the textile in one or more predetermined areas. Application, in aspects, may occur via a digital printing process, an ink-jet printing process, a screen printing process, a roller printing process, and the like. The alkaline fiber-decomposing agent is configured to degrade the CD PET yarns in the first layer as well as at least a portion of the length of the CD PET multifilament or monofilament tie yarns in the third layer upon application of heat.

Continuing, parameters associated with the textile such as type of knit construction and/or the use of multifilament or monofilament tie yarns may be selected to achieve a particular aesthetic and functional effect. For instance, the selection of a continuous knit construction using fine denier CD PET yarns for the first layer may facilitate the penetration of the alkaline fiber-decomposing agent through the first layer to the CD PET monofilament or multifilament tie yarns in the third layer. When CD PET monofilament yarns are selected for the third layer, the result is removal of the continuous knit first layer and removal of the monofilament tie yarns leaving just the second layer in areas of the textile to which the alkaline fiber-decomposing agent is applied. When CD PET multifilament yarns are selected for the third layer, the result is removal of the continuous knit first layer and the "loop" portion of the multifilament tie yarns producing a plush or pile effect in areas of the textile to which the alkaline fiber-decomposing agent is applied.

In another example, a mesh construction may be selected for the first layer along with CD PET multifilament tie yarns in the third layer. This selection allows for greater penetration of the alkaline fiber-decomposing agent through the holes in the mesh construction and less penetration of the alkaline fiber-decomposing agent through the remaining portions (i.e., non-hole portions) of the mesh construction. The result is removal of the first layer along with a portion of the length of the CD PET multifilament tie yarns in areas adjacent to the holes in the first layer and removal of the loop portion of the CD PET multifilament tie yarns in areas corresponding to the non-hole portions of the mesh construction. This produces variable length tie yarns in areas where the alkaline fiber-decomposing agent is applied.

Parameters associated with the alkaline fiber-decomposing agent may also be adjusted to facilitate the removal of the CD PET yarns in the first layer and some or all of the CD PET monofilament or multifilament yarns in the third layer. For instance, the type of alkaline fiber-decomposing agent, the amount of the alkaline fiber-decomposing agent applied to the textile, the concentration of the alkaline fiber-decomposing agent, and the like, may be controlled during the application step to remove varying lengths of the CD PET multifilament or monofilament tie yarns. As well, parameters associated with the heat application step such as time and temperature may be controlled to remove varying lengths of the CD PET multifilament or monofilament tie yarns. The non-CD PET yarns in the third layer are unaffected by the alkaline fiber-decomposing agent and, thus, the integrity or continuity of the third layer is maintained after the application and subsequent removal of the alkaline fiber-decomposing agent.

Accordingly, aspects herein are directed to an integral, three-dimensional spacer textile comprising a first area comprising a first layer having a mesh construction with a plurality of integrally formed holes, the first layer having at least a first outer surface defining a first outer surface plane, a second layer having at least a second inner surface, and a third layer, the third layer comprising a first multifilament tie yarn of a first plurality of multifilament tie yarns that interconnect the first layer and the second layer, the first multifilament tie yarn having a first length in the first area as measured between the second inner surface and the first outer surface plane. The spacer textile additionally comprises a second area comprising the second layer and a second multifilament tie yarn of a second plurality of multifilament tie yarns in the third layer, wherein the second multifilament tie yarn comprises a second length as measured between the second inner surface and a distal end of the second multifilament tie yarn in a direction extending toward the first outer surface plane, the second length less than the first length.

Aspects herein are further directed to a garment comprising an integral, three-dimensional spacer textile, the spacer textile comprising a first area having a first layer having a mesh construction, the first layer having at least a first outer surface defining a first outer surface plane, a second layer having at least a second inner surface, and a third layer, the third layer comprising a first multifilament tie yarn of a plurality of multifilament tie yarns that interconnect the first layer and the second layer, the first multifilament tie yarn having a first length in the first area as measured between the second inner surface and the first outer surface plane. The spacer textile further comprises a second area comprising the second layer and a second multifilament tie yarn of a second plurality of multifilament tie yarns in the third layer, wherein the second multifilament tie yarn comprises a second length as measured between the second inner surface and a distal end of the second multifilament tie yarn in a direction extending toward the first outer surface plane, the second length less than the first length.

Aspects herein are additionally directed to an integral three-dimensional spacer textile comprising a first area comprising a first layer having a continuous knit construction, the first layer having at least a first outer surface defining a first outer surface plane, a second layer having at least a second inner surface, and a third layer, the third layer comprising a first multifilament tie yarn of a first plurality of multifilament tie yarns that interconnect the first layer and the second layer, the first multifilament tie yarn having a first length in the first area as measured between the second inner surface and the first outer surface plane. The three-dimensional space textile further comprises a second area comprising the second layer and a second multifilament tie yarn of a second plurality of multifilament tie yarns in the third layer, wherein the second multifilament tie yarn comprises a second length as measured between the second inner surface and a distal end of the second multifilament tie yarn in a direction extending toward the first outer surface plane, the second length less than the first length.

Aspects herein are also directed to an integral three-dimensional spacer textile comprising a first area comprising a first layer having a continuous knit construction, the first layer having at least a first inner surface defining a first inner surface plane, a second layer having at least a second inner surface, and a third layer, the third layer comprising a first monofilament tie yarn of a first plurality of monofilament tie yarns that interconnect the first layer and the second layer, the first monofilament tie yarn having a first length in the first area as measured between the second inner surface and the first inner surface plane. The three-dimensional spacer textile also comprises a second area comprising the second layer and a second monofilament tie yarn of a second plurality of monofilament tie yarns in the third layer, wherein the second monofilament tie yarn comprises a second length as measured between the second inner surface and a distal end of the second monofilament tie yarn in a direction extending toward the first inner surface plane, the second length less than the first length.

Positional terms as used herein to describe a garment such as "anterior," "posterior," "front," "back," "upper," "lower," "inner-facing surface," "outer-facing surface," and the like are with respect to the garment being worn as intended and as shown and described herein by a wearer standing in an upright position. The term "spacer textile," as used herein is meant to encompass both warp knit and weft knit spacer textiles as is known in the art of textiles. Spacer textiles are generally formed by utilizing at least one tie yarn to interknit first and second layers of the textile. More specifically, each of the first layer and the second layer may be knit separately, and the tie yarn(s) is used to connect the first layer and the second layer. For instance, the tie yarns may have "loop" portions that extend into each of the first layer and the second layer where the loop portions are interlooped with yarns in the first layer and the second layer to connect the two layers. The distance between the first layer and the second layer may be varied by, for instance, varying the length of the tie yarn that extends between the first layer and the second layer. For example, the distance between the first layer and the second layer may be from about 1 mm to about 20 mm depending on the length of the tie yarn extending between the first layer and the second layer.

Because each of the first layer and the second layer are knit separately, each of the first layer, the second layer, and the third layer may be knit with different yarns and/or different yarn types. However, within a given layer (e.g., the first layer, the second layer, or the third layer), a particular yarn may extend throughout at least a portion of that layer. Because the first layer and the second layer may be knit independently of each other using different yarn types, the two layers may have different knit structures (e.g., mesh versus continuous) and exhibit different properties.

The term "terephthalate polymer-based" when describing, for example, a yarn means a yarn having filaments and/or fibers formed from terephthalate polymers and includes, for example, polyethylene terephthalate (PET), poly 1,4 cyclohexylene-dimethylene terephthalate (PCDT), polybutylene terephthalate (PCT) and polytrimethylene terephthalate (PTT). Aspects herein also contemplate using cationic-dyeable (CD) PET yarns. As used herein, CD PET yarns may comprise PET yarns which have been modified during polymerization to generate anionic sites (e.g., sulfonic acid groups). The term "non-CD PET yarns" as used herein refers to PET yarns that have not been modified as described herein. The term "non-CD PET yarns" may also refer to other non-PET yarn types such as polyamide yarns, cotton yarns, elastomeric yarns, and the like. The term "polyamide-based" when describing yarns means a yarn having filaments and/or fibers formed from any long-chain synthetic polyamide. The term "elastomeric" as used herein when describing yarns generally means a yarn type that may provide a maximum stretch greater than about 200% under load prior to returning to its non-stretched state when the load is removed, and some elastomeric yarns provide a maximum stretch of about 400%. Examples of elastomeric yarn types include Spandex®, lycra, rubber, and the like.

The term "mesh" as used herein means a textile having a knit construction where openings are created by modifying the knitting process used to form the textile (e.g., by dropping or transferring stiches). The term "continuous knit construction" as used herein means a textile having a continuous knit face without integrally formed or engineered openings (e.g., without intentionally dropped or transferred stitches). Examples would include a single jersey knit construction, a half tricot knit construction, a double jersey knit construction, and the like. The term "multifilament yarn" as used herein means a yarn having two or more filaments within a single yarn strand while the term "monofilament" as used herein means a yarn formed from a single filament.

As well, the term "integral" as used herein means a textile having at least one textile element (e.g., yarn, thread, filament, or fiber) that extends between different areas of a textile. For instance, with respect to the spacer textile described herein, the term "integral spacer textile" may mean a spacer textile having a continuous yarn that extends through different areas of the first layer and/or the second layer of the spacer textile, or a tie yarn that extends through different areas of at least the third layer of the spacer textile as well as portions of the first layer and the second layer. To describe this with respect to a knit construction, the term "integral spacer textile" may mean a spacer textile having a yarn from one area being interlooped with one or more knit courses of another area in the first layer and/or second layer and/or the third layer of the spacer textile. This may be opposed to a panel type construction where two or more separate materials are joined by affixing edges or surfaces by, for example, stitching, bonding, adhesives, and the like, such that there is not continuity of a yarn or textile element between the two materials.

Turning now to FIG. 1, a spacer textile 10 is illustrated in accordance with aspects herein. The spacer textile 10 is provided to illustrate features associated with the tie yarns that interknit the different layers of the spacer textile 10 and to illustrate various reference planes that may be described with respect to aspects herein. The spacer textile 10 comprises a first layer 1 having a first inner surface 6 defining a first inner surface plane 11 that extends in an x-direction and a y-direction and a first outer surface 7 defining a first outer surface plane 15 extending in the x-direction and the y-direction. As described further below, the first layer 1 may comprise a continuous knit construction or a mesh knit construction in accordance with aspects herein, where the continuous knit construction or the mesh construction is formed using CD PET yarns.

Continuing, the spacer textile 10 further comprises a second layer 2 having a second inner surface 8 defining a second inner surface plane 12 extending in the x-direction and the y-direction and a second outer surface 9 defining a second outer surface plane 13 extending in the x-direction and the y-direction. In accordance with aspects herein, the second layer 2 may comprise a continuous knit construction formed using non-CD PET yarns. In aspects, non-CD PET yarns may comprise PET yarns, polyamide yarns, cotton yarns, elastomeric yarns, and the like.

The spacer textile 10 further comprises a third layer 3 comprising one or more tie yarns 14 that are interknitted with the first layer 1 and the second layer 2. Although only one tie yarn 14 is shown for the third layer 3, it is contemplated herein that the third layer 3 may be formed using more than one tie yarn. The portions of the tie yarn 14 indicated by the reference numerals 4 and 5 and shown in dashed lines to indicate they are generally hidden from view represent those areas of the tie yarn 14 that are interlooped with the yarns forming the first layer 1 and the second layer 2 respectively. As used throughout this disclosure, the term "loop" or "loop portion" when referring to tie yarns refers to the portion of the tie yarn that extends into the first layer 1 and the second layer 2 and is interlooped with yarns in the first layer 1 and the second layer 2. To describe it a different way, the loop portion of the tie yarn is that portion of the tie yarn that does not extend between the first inner surface plane 11 and the second inner surface plane 12 of the spacer textile 10. Aspects herein contemplate that the third layer 3 is formed using CD PET monofilament or multifilament yarns.

Figure 2:
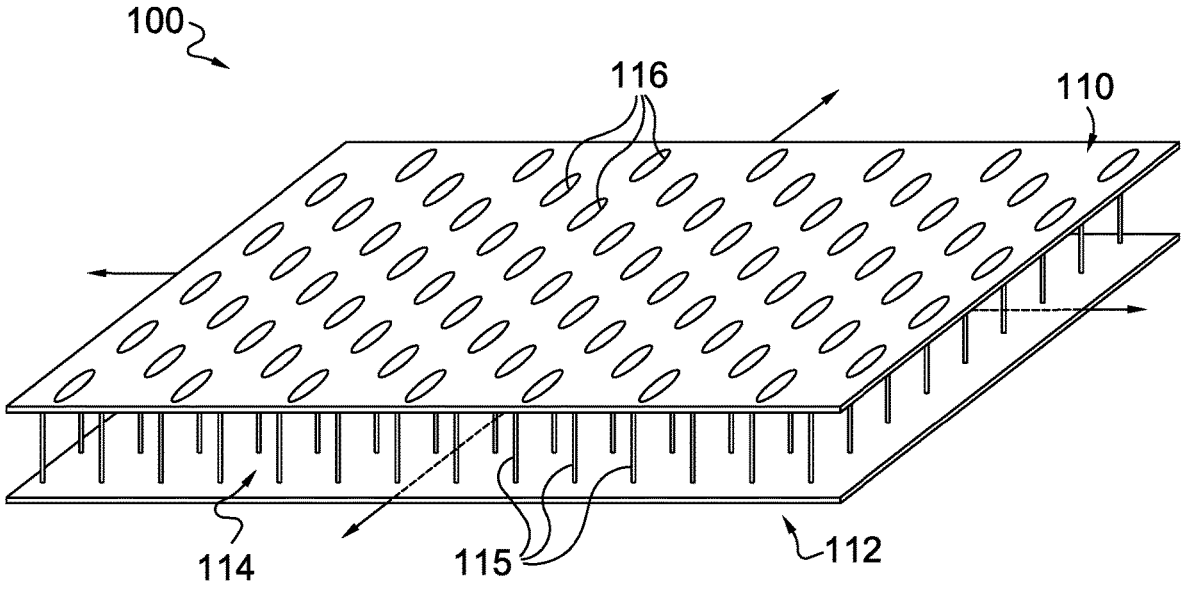
FIG. 2 illustrates a perspective view of a first surface of a spacer textile in accordance with aspects herein.
Figure 3:
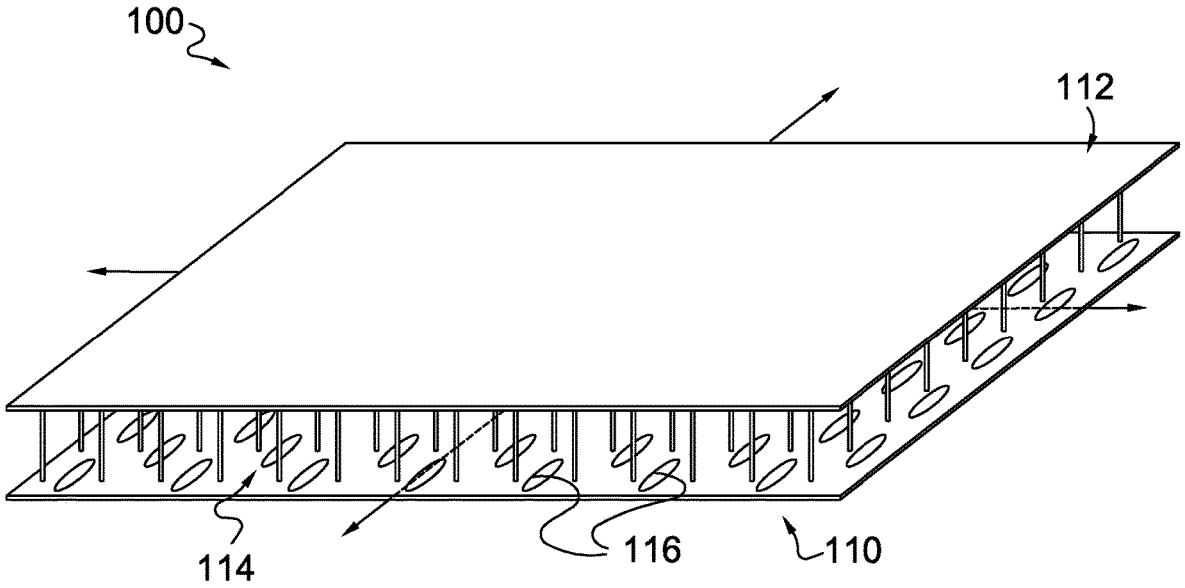
FIG. 3 illustrates a perspective view of the spacer textile of FIG. 2 showing the second opposite surface in accordance with aspects herein.

With this as reference and turning now to FIGS. 2 and 3, perspective views of a first spacer textile 100 are illustrated in accordance with aspects herein, where the spacer textile 100 is illustrated from two opposite surfaces. The spacer textile 100 comprises a first layer 110 (best shown in FIG. 2), a second layer 112 opposite the first layer 110 (best shown in FIG. 3), and a third layer 114 positioned primarily between the first layer 110 and the second layer 112. With respect to FIG. 2, the first layer 110 may be thought of as extending in a first x, y plane as shown by the arrows. Similarly, and with respect to FIG. 3, the second layer 112 may also be thought of as extending in a second x, y plane, where the second x, y plane is offset from but generally parallel to the first x, y plane.

In one aspect, the first layer 110 comprises a mesh knit construction with a plurality of integrally formed holes 116. The holes 116 may be knit to have one or more sizes and the hole size may be variable or uniform over the surface of the first layer 110. As better depicted in FIG. 4, the holes 116 extend through the thickness of the first layer 110 such that they are in fluid communication with the third layer 114 and with the space formed between the first layer 110 and the second layer 112.

In aspects, the first layer 110 may be formed using a first yarn type comprising CD PET. The yarns forming the first layer may have a denier from about 25 D to about 35 D, from about 27 D to about 33 D, from about 29 D to about 31 D, or about 30 D. As used herein, the term "about" means within ±10% of a designated value.

With respect to FIG. 3, in aspects, the second layer 112 comprises a continuous knit construction without integrally formed holes. In aspects, the second layer 112 may be formed using at least a second yarn type comprising, for instance, polyamide. More specifically, the polyamide includes caprolactam (also known as nylon 6). However, as noted above, the second layer 112 may also be formed using other non-CD PET yarns such as regular PET, cotton, and the like. The second layer 112 may be further formed using an elastomeric yarn type to provide stretch properties to the spacer textile 100. More specifically, the second layer 112 may be formed using a caprolactam yarn that covers or is wrapped around an elastomeric core; the elastomeric core may comprise elastane. The covered yarn may have a denier from about 70 D to about 80 D, from about 73 D to about 78 D, from about 74 D to about 76 D, or about 75 D.

In aspects, the third layer 114 comprises one or more multifilament tie yarns 115 that are interknitted with the first layer 110 and the second layer 112 so as to interconnect these layers. As explained further below with respect to FIG. 4, the non-loop portions of the tie yarns 115 may have a predetermined length as measured between the inner-facing surface of the first layer 110 and the inner-facing surface of the second layer 112 so as to space apart the first layer 110 and the second layer 112 by a predetermined amount such as, for example, about 4 mm.

Continuing, the distance between adjacent tie yarns 115 (as measured in for example, the x-direction and the y-direction) may be adjusted to provide varying degrees of compressibility of the spacer textile 100. For instance, the spacing may be decreased (e.g., more tie yarns per given area) to decrease the compressibility of the spacer textile 100, and the spacing may be increased (e.g., less tie yarns per given area) to increase the compressibility of the spacer textile 100. Thus, although the tie yarns 115 are shown in FIGS. 2 and 3 as being spaced apart a certain distance, it is contemplated herein that other spacing configurations may be used. Further, although the tie yarns 115 are shown as extending in a vertical orientation between the first layer 110 and the second layer 112 such that they are generally perpendicular to the first layer 110 and the second layer 112, it is contemplated herein that the tie yarns 115 may comprise other orientations instead of vertical. For instance, when the spacer textile 100 is in an uncompressed state (i.e., a resting state) the tie yarns 115 may be positioned generally perpendicular to the first layer 110 and the second layer 112 or may be skewed from a vertical orientation by up to, for example, ±70 degrees.

Continuing, in aspects, the tie yarns 115 may be formed of a third yarn type where the third yarn type comprises CD PET. The yarns forming the third layer may have a denier from about 15 D to about 25 D, from about 17 D to about 23 D, from about 19 D to about 21 D, or about 20 D. Each of the tie yarns 115 may comprise from about 18 to about 30 filaments per tie yarn, from about 20 to about 28 filaments per tie yarn, from about 23 to about 25 filaments per tie yarn, or about 24 filaments per tie yarn.

Figure 4:
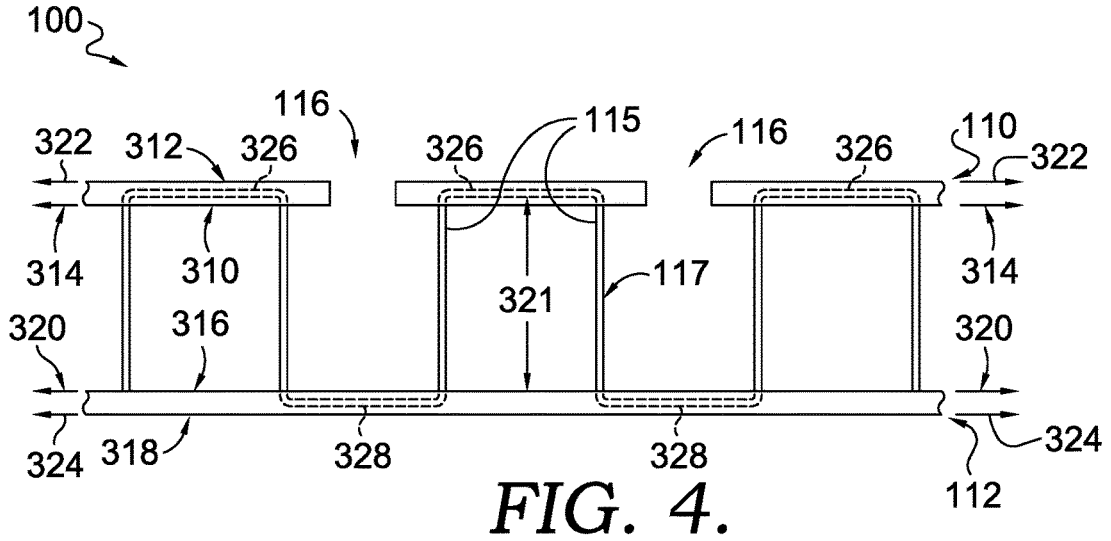
FIG. 4 illustrates a cross-section view of the spacer textile of FIGS. 2 and 3 in accordance with aspects herein.

FIG. 4 illustrates a cross-section view or side view of the spacer textile 100 in accordance with aspects herein. As shown, the first layer 110 of the spacer textile 100 may comprise a first inner surface 310 and a first outer surface 312 opposite the first inner surface 310. The holes 116 extending through the first layer 110 are shown in FIG. 4. As described above, the first layer 110 may be thought of as extending along an x, y plane. More specifically, the first inner surface 310 may extend along or define a first inner surface plane as represented by arrows 314, where the first inner surface plane 314 extends in an x-direction and a y-direction. And the first outer surface 312 may extend along or define a first outer surface plane as represented by arrows 322, where the first outer surface plane 322 extends in an x-direction and a y-direction. As well, the second layer 112 of the spacer textile 100 may comprise a second inner surface 316 and a second outer surface 318 opposite the second inner surface 316. Similar to the first inner surface 310, the second inner surface 316 may also extend along or define a second inner surface plane as represented by arrows 320, where the second inner surface plane 320 extends in an x-direction and a y-direction and where the second inner surface plane 320 is parallel to but offset from the first inner surface plane 314. As well, the second outer surface 318 may extend along or define a second outer surface plane as represented by arrows 324, where the second outer surface plane 324 extends in an x-direction and a y-direction.

Continuing with respect to FIG. 4, the tie yarns 115 are shown extending between at least the first inner surface 310 of the first layer 110 and the second inner surface 316 of the second layer 112 with loop portions 326 of the tie yarns 115 extending into the first layer 110 and loop portions 328 of the tie yarns 115 extending into the second layer 112 to interconnect the layers 110 and 112. To describe this a different way, for the spacer textile 100 shown in FIG. 4, the non-loop portions of the tie yarns 115 extend between at least the second inner surface plane 320 and the first inner surface plane 314.

As described above, it is contemplated herein that the loop portions 326 and 328 of the tie yarns 115 may extend into the first layer 110 and the second layer 112 respectively. As such, a particular tie yarn, such as tie yarn 117 may comprise a first length 321 as measured between the second inner surface 316 (or the second inner surface plane 320) and the loop portion 326 of the tie yarn 117 in the direction of the first outer surface plane 322. Because of variabilities in the knitting process used to create the spacer textile 100, it is contemplated that the tie yarns 115 may not comprise all the same length (e.g., first length 321), but instead, the tie yarns 115 may comprise a first average length.

Figure 5:
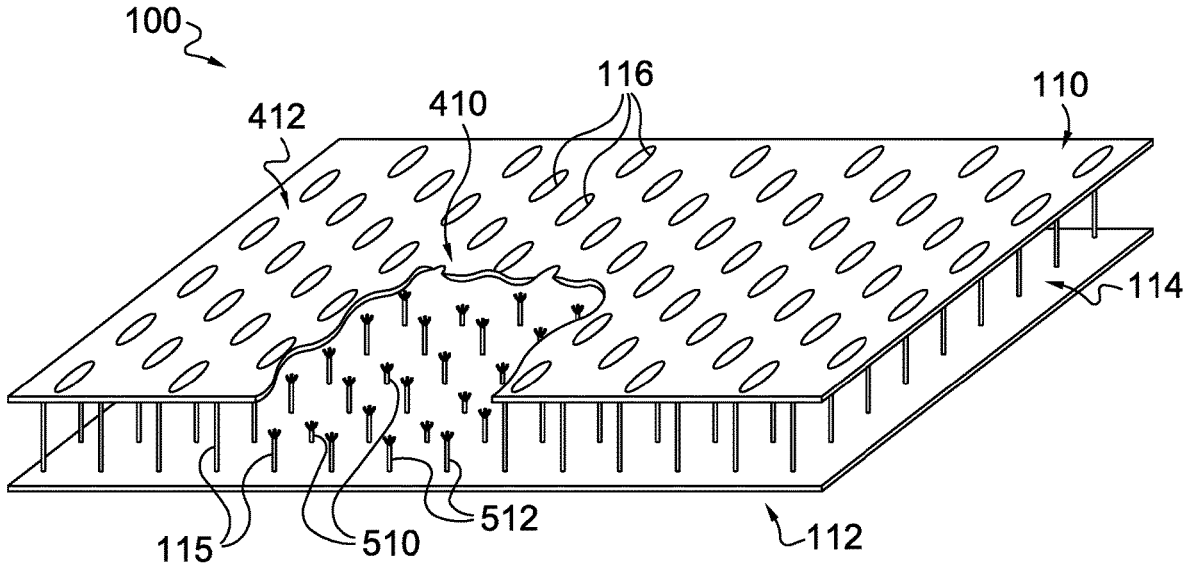
FIG. 5 illustrates the spacer textile of FIGS. 2-4 with an area where a portion of the first layer and a portion of the length of the tie yarns are removed in accordance with aspects herein.

Turning now to FIG. 5, a perspective view of the spacer textile 100 is shown after a portion of the first layer 110 has been removed at a second area 410 of the spacer textile 100 and after variable length portions of the multifilament tie yarns 115 have been removed in the second area 410 (now labelled as tie yarns 510 and 512). Remaining areas of the spacer textile 100 excluding the second area 410 may be known herein as a first area(s) 412. To describe this differently, FIG. 5 depicts the spacer textile 100 as comprising at least a first area 412 having the first layer 110, the second layer 112, and the third layer 114, and at least a second area 410 having the second layer 112, a portion of the third layer 114, and no first layer 110. As will be explained in greater depth below, an alkaline fiber-decomposing agent may be applied to the first layer 110 at the second area 410 using example application processes. The alkaline fiber-decomposing agent is configured to remove/degrade the CD PET yarns in the first layer 110 at the second area 410. As well, the alkaline fiber-decomposing agent is configured to remove at least a portion of the length of the CD PET multifilament tie yarns 115 in the second area 410. The second layer 112, formed from non-CD PET yarns, and/or polyamide-based yarn types and elastomeric yarn types is unaffected by the alkaline fiber-decomposing agent.

With this as background and with respect to FIG. 5, the second area 410 is shown as having a generally rectangular shape but it is contemplated that the second area 410 may comprise any shape including shapes associated with branding such as logos, images, and the like, geometric shapes, organic shapes, letters, numbers, and the like. Moreover, although only one second area 410 is shown, it is contemplated herein that the spacer textile 100 may comprise multiple second areas 410 with each second area 410 having the same shape or a different shape. When the spacer textile 100 comprises multiple second areas 410, it is contemplated herein that the first area 412 may extend around or circumscribe at least a portion of the second areas 410. Any and all aspects, and any variation thereof, are contemplated as being within aspects herein.

As mentioned, in the second area 410, the first layer 110 is removed or absent along with variable length portions of the tie yarns 115. More particularly with respect to the tie yarns in the second area 410, tie yarns located in areas adjacent to the holes 116 in the first layer 110 prior to application of the alkaline fiber-decomposing agent, such as tie yarns 510, may have a greater portion of their length removed as compared to tie yarns located in areas positioned further away from the holes 116 in the first layer 110 prior to the application of the alkaline fiber-decomposing agent, such as tie yarns 512. In aspects, this may be due to a greater penetration of the alkaline fiber-decomposing agent through the holes 116 as compared to the penetration of the alkaline fiber-decomposing agent in the non-hole areas of the first layer 110. Because of the greater penetration of the alkaline fiber-decomposing agent through the holes 116, tie yarns located adjacent to the holes 116 may be degraded to a greater extent than tie yarns located further away from the holes 116. Further, with respect to the tie yarns located further away from the holes, it is contemplated herein that the loop portion 326 of these tie yarns may be removed or degraded upon application of the alkaline fiber-decomposing agent to the first layer 110, but the remaining length of the tie yarns (e.g., the length between the first inner surface plane 314 and the second inner surface plane 320) may still be present.

With respect to particular yarns located in the second area 410 (e.g., tie yarn 510 and tie yarn 512), when a portion of the length of the tie yarn 510 is removed, or when the loop portion of the tie yarn 512 is removed, it is contemplated that the integrity of the multifilament yarn strand forming the tie yarns 510 and 512 is disrupted so that the filaments within the tie yarns 510 and 512 are no longer tightly packed at least at their distal ends (i.e., the end closest to the first inner surface plane 314) such that the filaments spread out with respect to one another. The result is that areas surrounding the second area 410 (e.g., the first area 412) have the look of a spacer textile, while the second area 410 has the look of a plush or pile-type textile with variable length yarns (e.g., tie yarns 510 and tie yarns 512). Functionally, the spacer textile 100 shown in FIG. 5 would exhibit functional properties associated with spacer textiles in the first area 412 such as compressibility, insulation, thermoregulation, and increased air permeability as compared to non-spacer textile knit constructions. Because the second area 410 comprises a more open construction with the first layer 110 being absent along with variable length portions of the tie yarns, the second area 410 generally exhibits a higher level of air permeability as compared to the first area 412 of the spacer textile.

Figure 6:
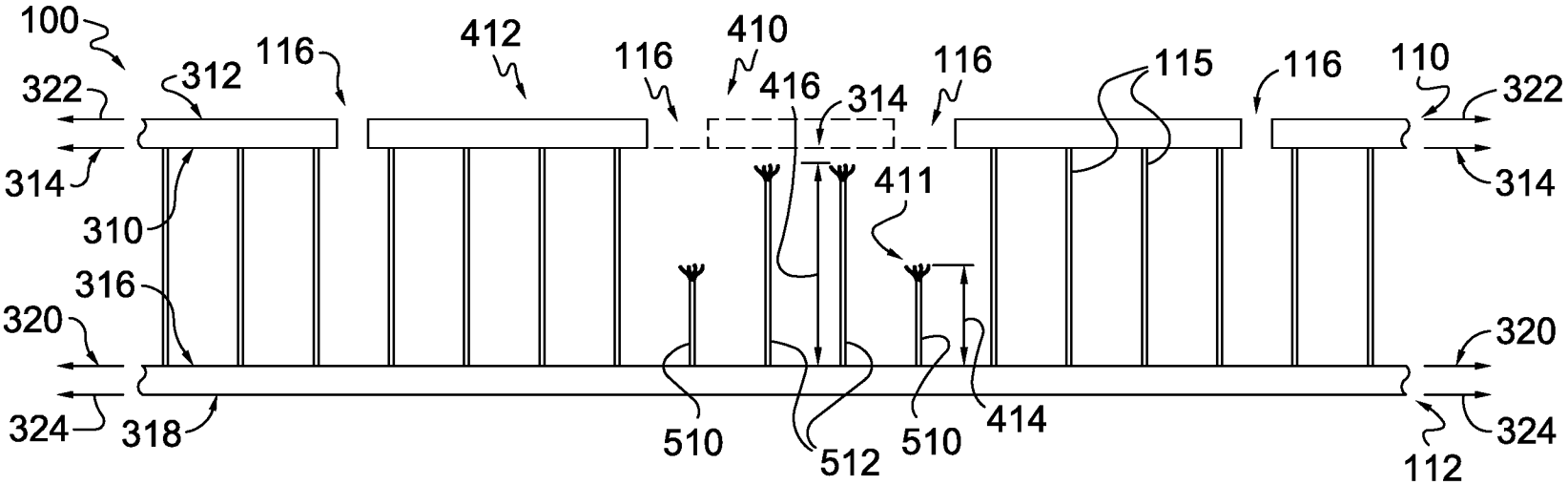
FIG. 6 illustrates a cross-section view of the spacer textile of FIG. 5 in accordance with aspects herein.

FIG. 6 depicts a cross-section view of the spacer textile 100 of FIG. 5 in accordance with aspects herein. As seen, in the second area 410, the first layer 110 is absent and the tie yarns 510 and 512 in the second area 410 comprise at least two different lengths. To aid in the following disclosure, the area where the first layer 110 was present prior to removal is shown in dashed lines to provide an indication of the location of the holes 116 and the non-hole areas of the removed first layer 110. The tie yarns 510 located adjacent to the holes 116 (i.e., the tie yarns 510 located along a reference line or reference plane extending through the holes 116 in a direction toward the second layer 112) are shown as having a shorter length as compared to the tie yarns 512 located further away from the holes 116 (i.e., the tie yarns 512 that would not be intersected by a reference line or reference plane extending through the holes 116 in a direction toward the second layer 112). For example, the tie yarns 510 may comprise a second length 414 as measured between the second inner surface 316 (or second inner surface plane 320) and a distal end of the tie yarns 510 in a direction extending toward the first outer surface plane 322. In aspects, the second length 414 of the tie yarns 510 is less than the first length 321 of the tie yarn 117 in the first area 412. Moreover, it is contemplated herein that the second length 414 of the tie yarns 510 is greater than zero (i.e., not all of the length of the tie yarns 510 is removed).

Continuing, the tie yarns 512 located in the non-hole portions of the removed first layer 110 may comprise a third length 416 as measured between the second inner surface 316 (or second inner surface plane 320) and a distal end of the tie yarns 512 in a direction extending toward the first outer surface plane 322. In aspects, the third length 416 of the tie yarns 512 may be greater than the second length 414 of the tie yarns 510 but less than the first length 321 of the tie yarn 117 in the first area 412. Because of variabilities in the process used to remove the first layer 110 and a portion of the length of the tie yarns 510 and 512 in the second area 410, it is contemplated that the tie yarns 510 in the second area 410 may not comprise all the same length (e.g., second length 414) and it is further contemplated herein that the tie yarns 512 in the second area 410 may not comprise all the same length (e.g., third length 416).

Figure 7:
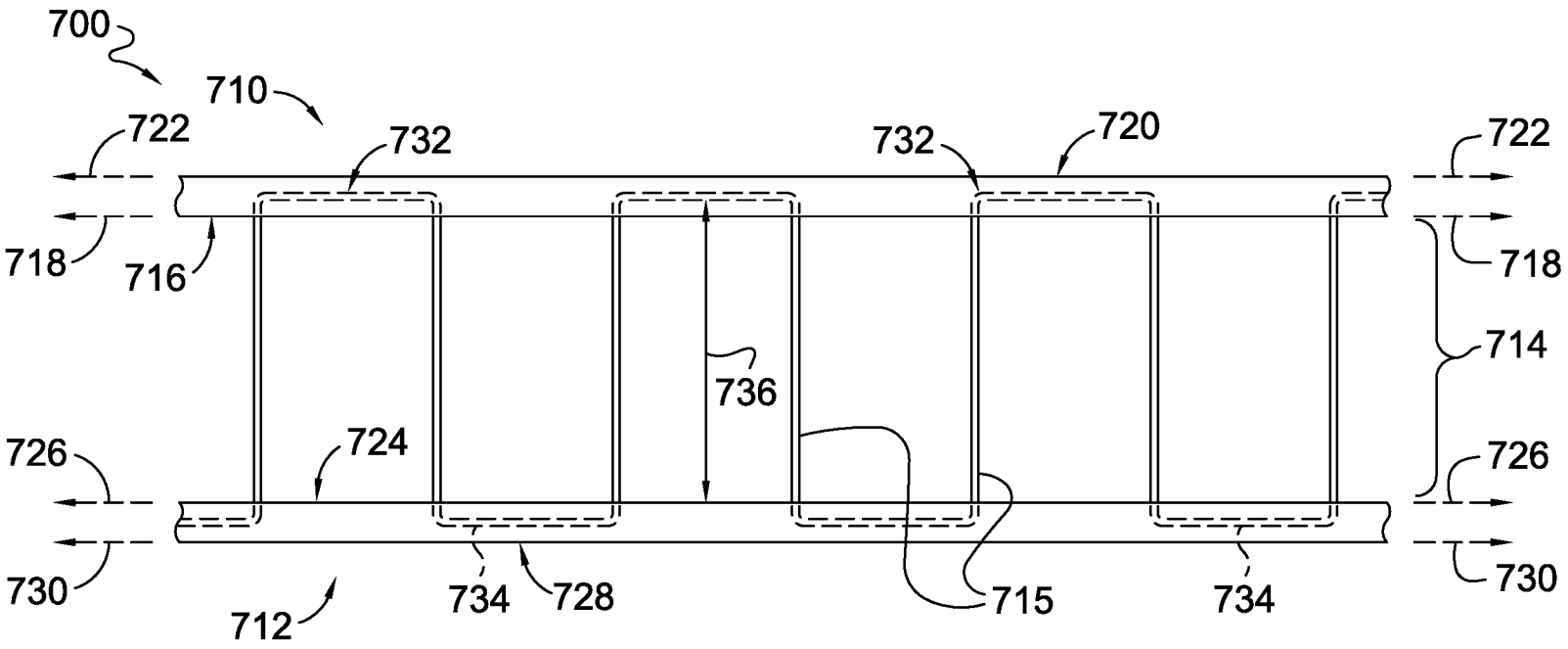
FIG. 7 illustrates a cross-section view of a second alternative spacer textile in accordance with aspects herein.
Figure 8:
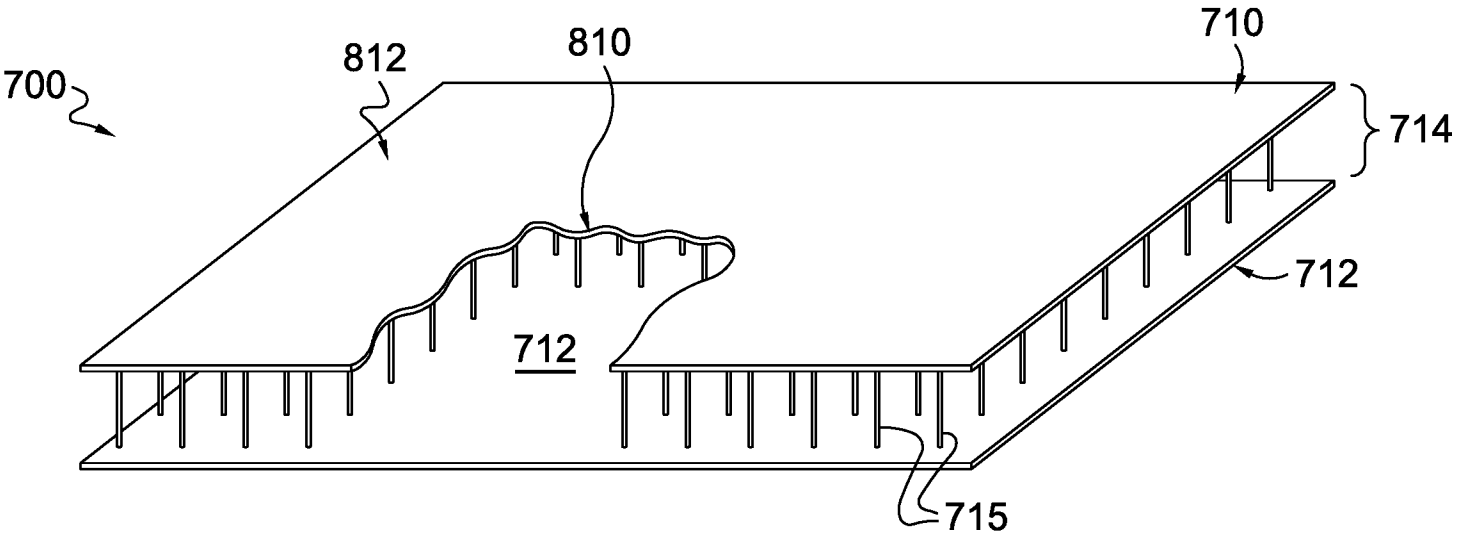
FIG. 8 illustrates a perspective view of the spacer textile of FIG. 7 with an area where a portion of the first layer and tie yarns are removed in accordance with aspects herein.
Figure 9:
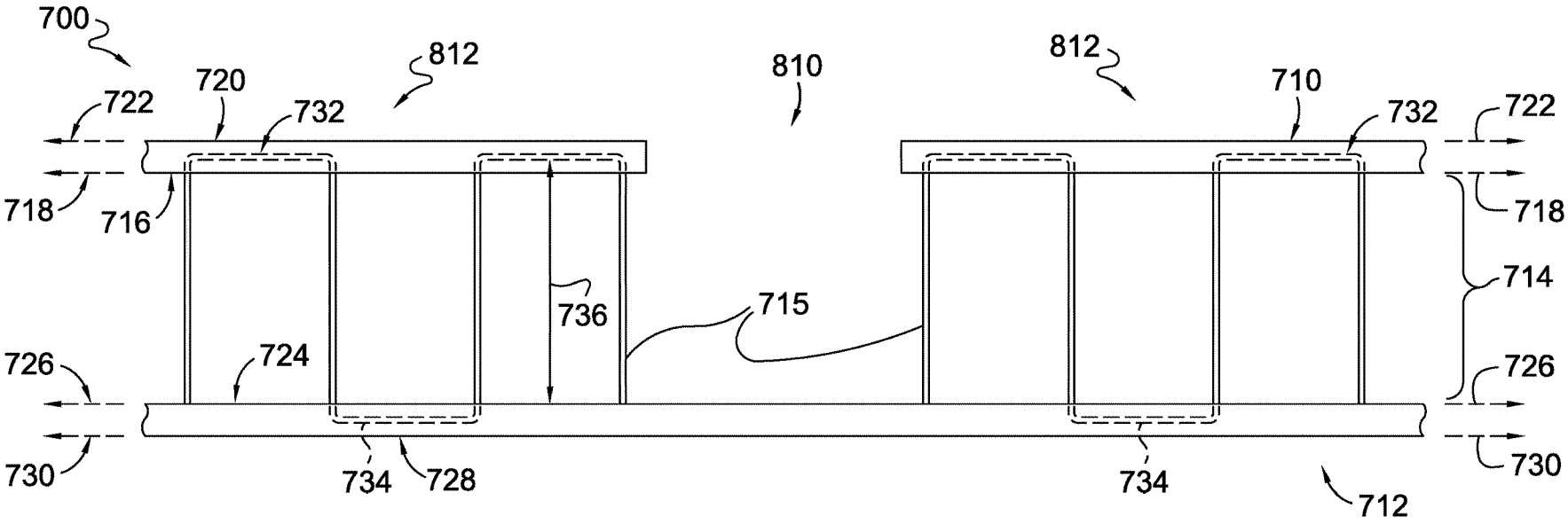
FIG. 9 illustrates a cross-section view of the spacer textile of FIG. 8 in accordance with aspects herein.

Turning now to FIG. 7-9, a second configuration for a spacer textile 700 is provided in accordance with aspects herein. With respect to FIG. 7, which illustrates a cross-section view of the spacer textile 700, the spacer textile 700 comprises a first layer 710, a second layer 712, and a third layer 714 that interconnects the first layer 710 and the second layer 712. In aspects, the first layer 710 comprises a continuous knit construction formed using CD PET yarns having a denier from about 18 denier to about 26 denier, from about 20 denier to about 24 denier, or about 22 denier. The second layer 712 may also comprise a continuous knit construction formed using non-CD PET yarns. In aspects, the non-CD PET yarns may comprise polyamide yarns and elastomeric yarns, and, in aspects, the elastomeric yarns may be wrapped with the polyamide yarns such that the yarns have a denier from about 40 denier to about 60 denier, from about 45 denier to about 55 denier, or from about 48 denier to about 50 denier. In aspects, the third layer 714 may comprise one or more monofilament CD PET tie yarns 715 having a denier from about 10 denier to about 20 denier, from about 13 denier to about 18 denier, or about 15 denier.

Similar to the spacer textile 100, the first layer 710 of the spacer textile 700 has a first inner surface 716 defining a first inner surface plane 718 and a first outer surface 720 defining a first outer surface plane 722. The second layer 712 of the spacer textile 700 comprises a second inner surface 724 defining a second inner surface plane 726 and a second outer surface 728 defining a second outer surface plane 730.

The monofilament tie yarns 715 that form the third layer 714 comprise loop portions 732 that are interlooped with yarns forming the first layer 710 and loop portions 734 that are interlooped with yarns forming the second layer 712 to interconnect the two layers 710 and 712. The non-loop portions of the tie yarns 715 extend between the first inner surface 716 and the second inner surface 724. In aspects, the tie yarns 715 may comprise at least a first length 736 as measured between the second inner surface 724 (or second inner surface plane 726) to the loop portion 732 of the tie yarns 715 in a direction extending toward the first outer surface 720 (or first outer surface plane 722).

FIG. 8 depicts a perspective view of the spacer textile 700 after an alkaline fiber-decomposing agent has been applied to a second area 810 of the spacer textile 700 to remove the first layer 710 in the second area 810 along with the monofilament tie yarns 715 that were located in the second area 810. Remaining areas of the spacer textile 700 excluding the second area 810 may be known herein as a first area(s) 812. To describe this differently, FIG. 8 depicts the spacer textile 700 as comprising at least a first area 812 having the first layer 710, the second layer 712, and the third layer 714, and at least a second area 810 having only the second layer 712 (i.e., no first layer 710 and no third layer 714). The use of fine denier yarns to knit the first layer 710 may allow for greater penetration of the alkaline fiber-decomposing agent into the third layer 714. This coupled with the use of fine denier monofilament CD PET tie yarns as opposed to multifilament tie yarns facilitates the degradation and removal of the tie yarns 715 by the alkaline fiber-decomposing agent.

Although the second area 810 is shown as having a generally rectangular shape, it is contemplated that the second area 810 may comprise any shape including shapes associated with branding such as logos, images, and the like, geometric shapes, organic shapes, letters, numbers, and the like. Moreover, although only one second area 810 is shown, it is contemplated herein that the spacer textile 700 may comprise multiple second areas 810 with each second area 810 having the same shape or a different shape. When the spacer textile 700 comprises multiple second areas 810, it is contemplated herein that the first area 812 may extend around or circumscribe at least a portion of the second areas 810. Any and all aspects, and any variation thereof, are contemplated as being within aspects herein.

With continued respect to FIG. 8, the areas surrounding the second area 810 (e.g., the first area 812) have the look and function of a spacer textile, while the second area 810 comprises just the second layer 712. Functionally, the spacer textile 700 would exhibit functional properties associated with spacer textiles in the first area 812 such as compressibility, insulation, thermoregulation, and increased air permeability as compared to non-spacer textile knit constructions. Because the second area 810 comprises a more open construction with the first layer 710 and the tie yarns 715 being removed, the second area 810 may exhibit a higher level of air permeability as compared to the first area 812 of the spacer textile 700.

FIG. 9 depicts a cross-section view or side view of the spacer textile 700 of FIG. 8 in accordance with aspects herein. As seen, in the second area 810, the first layer 710 is absent along with the tie yarns 715 such that the second area 810 comprises only the second layer 712 without the first layer 710 and without the tie yarns 715. The first area 812 comprises the first layer 710, the second layer 712, and the third layer 714, where the third layer comprises the tie yarns 715 having the first length 736.

Figure 10:
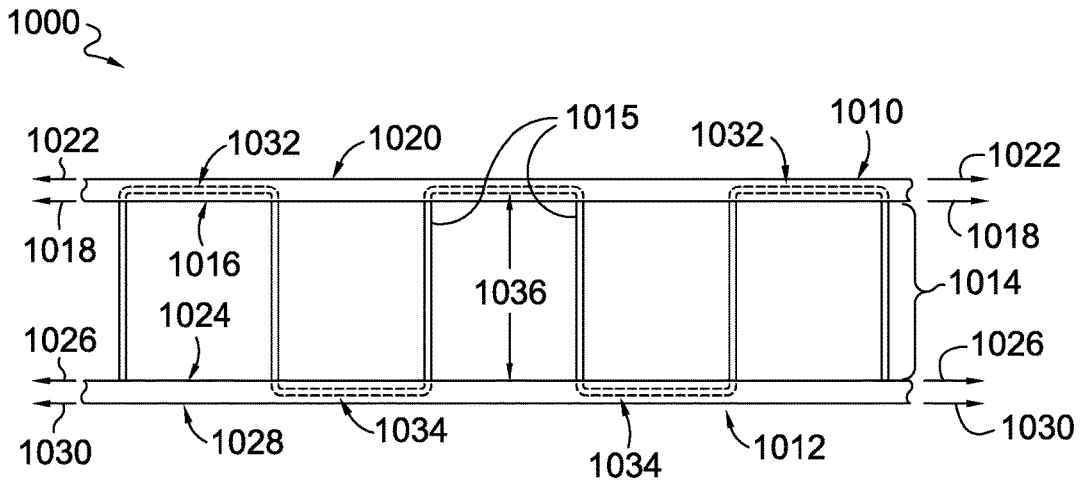
FIG. 10 illustrates a cross-section view of a third alternative spacer textile in accordance with aspects herein.
Figure 11:
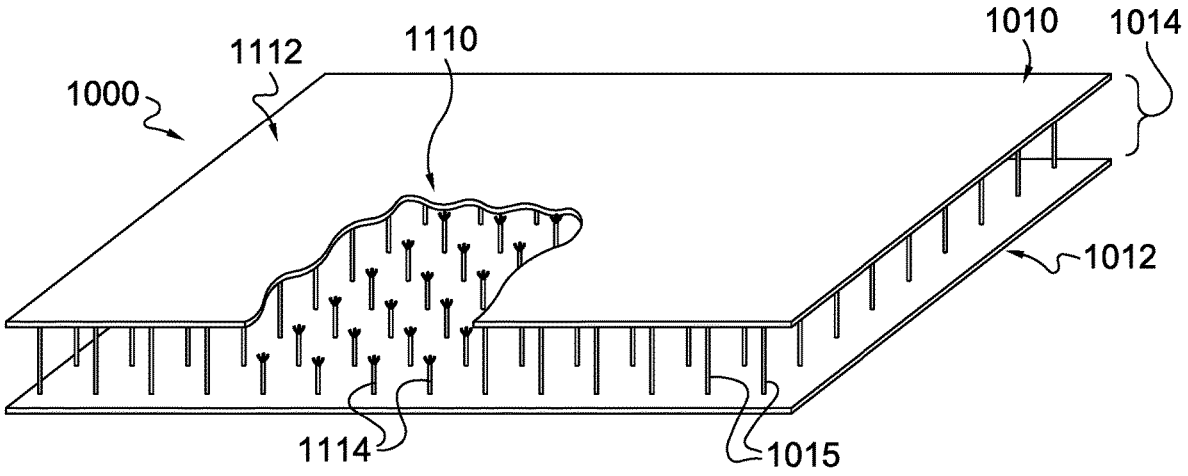
FIG. 11 illustrates a perspective view of the spacer textile of FIG. 10 with an area where a portion of the first layer and the loop portion of the tie yarns are removed in accordance with aspects herein.
Figure 12:
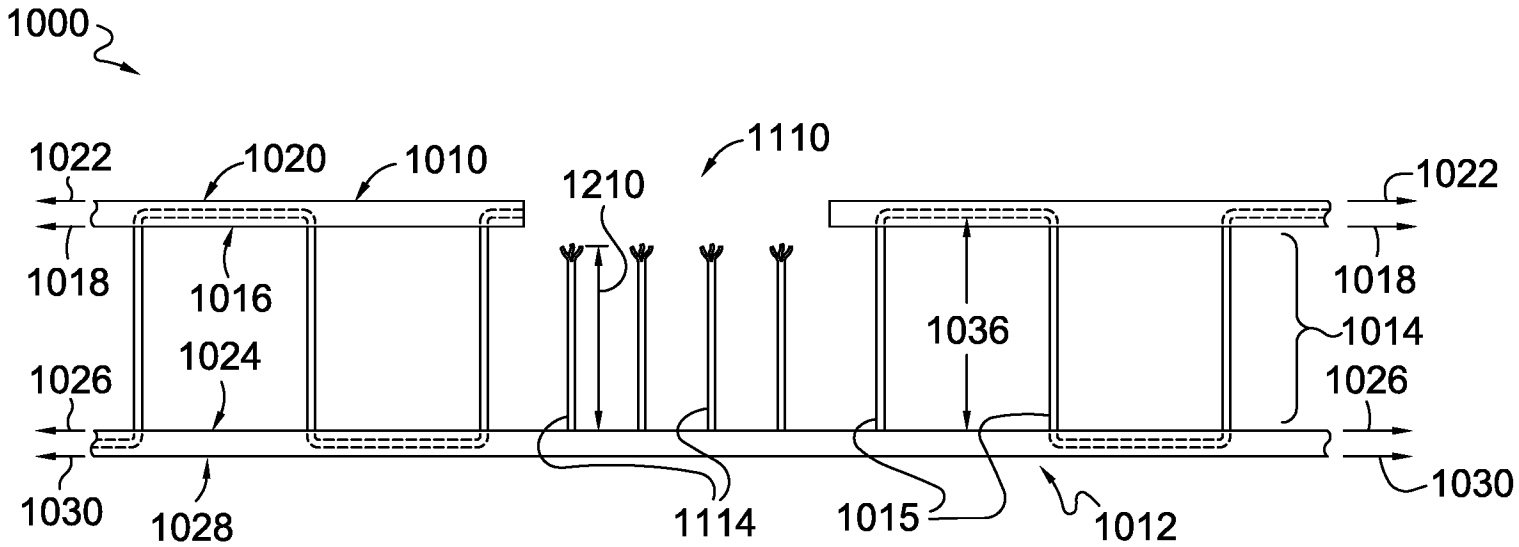
FIG. 12 illustrates a cross-section view of the spacer textile of FIG. 11 in accordance with aspects herein.

Turning now to FIGS. 10-12, a third configuration is provided in accordance with aspects herein. With respect to FIG. 10, a cross-section of a spacer textile 1000 is shown where the spacer textile comprises a first layer 1010, a second layer 1012, and a third layer 1014 that interconnects the first layer 1010 and the second layer 1012. In aspects, the first layer 1010 comprises a continuous knit construction formed using CD PET yarns having a denier from about 18 denier to about 26 denier, from about 20 denier to about 24 denier, or about 22 denier. The second layer 1012 may also comprise a continuous knit construction formed using non-CD PET yarns. In aspects, the non-CD PET yarns may comprise polyamide yarns and elastomeric yarns, and, in aspects, the elastomeric yarns may be wrapped with the polyamide yarns such that the yarns have a denier from about 40 denier to about 60 denier, from about 45 denier to about 55 denier, or from about 48 denier to about 50 denier. In aspects, the third layer 1014 may comprise one or more multifilament CD PET tie yarns 1015 having a denier from 15 D to about 25 D, from about 17 D to about 23 D, from about 19 D to about 21 D, or about 20 D. Each of the tie yarns 1015 may comprise from about 18 to about 30 filaments per tie yarn, from about 20 to about 28 filaments per tie yarn, from about 23 to about 25 filaments per tie yarn, or about 24 filaments per tie yarn.

Similar to the spacer textile 100 and the spacer textile 700, the first layer 1010 of the spacer textile 1000 has a first inner surface 1016 defining a first inner surface plane 1018 and a first outer surface 1020 defining a first outer surface plane 1022. The second layer 1012 of the spacer textile 1000 comprises a second inner surface 1024 defining a second inner surface plane 1026 and a second outer surface 1028 defining a second outer surface plane 1030.

The multifilament tie yarns 1015 that form the third layer 1014 comprise loop portions 1032 that are interlooped with yarns forming the first layer 1010 and loop portions 1034 that are interlooped with yarns forming the second layer 1012 to interconnect the two layers 1010 and 1012. The non-loop portions of the tie yarns 1015 extend between the first inner surface 1016 and the second inner surface 1024 such that the tie yarns 1015 comprise at least a first length 1036 as measured between the second inner surface 1024 (or second inner surface plane 1026) and the loop portion 1032 of the tie yarns 1015 in a direction extending toward the first outer surface 1020 (or the first outer surface plane 1022).

FIG. 11 depicts a perspective view of the spacer textile 1000 after an alkaline fiber-decomposing agent has been applied to a second area 1110 of the spacer textile 1000 to remove the first layer 1010 in the second area 1110 along with the loop portions 1032 of the multifilament tie yarns that were located in the second area 1110 (now labelled as tie yarns 1114). Remaining areas of the spacer textile 1000 excluding the second area 1110 may be known herein as a first area(s) 1112. To describe this differently, FIG. 11 depicts the spacer textile 1000 as comprising at least a first area 1112 having the first layer 1010, the second layer 1012, and the third layer 1014, and at least a second area 1110 having the second layer 1012 and the tie yarns 1114 without their loop portions 1032. The use of fine denier yarns to knit the first layer 1010 may allow for greater penetration of the alkaline fiber-decomposing agent into the loop portions 1032 of the tie yarns 1114 thereby helping to remove or degrade the loop portions 1032 of the tie yarns 1114 in the second area 1110.

Although the second area 1110 is shown as having a generally rectangular shape, it is contemplated that the second area 1110 may comprise any shape including shapes associated with branding such as logos, images, and the like, geometric shapes, organic shapes, letters, numbers, and the like. Moreover, although only one second area 1110 is shown, it is contemplated herein that the spacer textile 1000 may comprise multiple second areas 1110 with each second area 1110 having the same shape or a different shape. When the spacer textile 1000 comprises multiple second areas 1110, it is contemplated herein that the first area 1112 may extend around or circumscribe at least a portion of the second areas 1110. Any and all aspects, and any variation thereof, are contemplated as being within aspects herein.

Similar to the spacer textile 100, when the loop portion 1032 of the tie yarns 1015 are removed, the integrity of the multifilament yarn strand forming the ties yarns 1015 is disrupted such that the filaments within the yarn strand are no longer tightly packed together at least at their distal ends (the end closest to the first inner surface plane 1018) such that the filaments spread out with respect to one another. Thus, the areas surrounding the second area 1110 (e.g., the first area 1112) have the look of a spacer textile, while the second area 1110 has a plush or pile-type look with generally uniform length tie yarns 1114. Functionally, the spacer textile 1000 would exhibit functional properties associated with spacer textiles in the first area 1112 such as compressibility, insulation, thermoregulation, and increased air permeability as compared to non-spacer textile knit constructions. Because the second area 1110 comprises just the second layer 1012 and the tie yarns 1114, the second area 1110 may exhibit a higher level of air permeability as compared to the first area 1112 of the spacer textile 1000.

FIG. 12 depicts a cross-section view of the spacer textile 1000 of FIGS. 10-11 in accordance with aspects herein. As seen, in the second area 1110, the first layer 1010 is absent and the tie yarns 1114 in the second area 1110 lack their loop portions 1032. For example, the tie yarns 1114 may comprise a second length 1210 as measured between the second inner surface 1024 (or second inner surface plane 1026) and a distal end of the tie yarns 1114 in a direction extending toward the first outer surface plane 1022. In aspects, the second length 1210 of the tie yarns 1114 is less than the first length 1036 of the tie yarns 1015 in the first area 1112. Moreover, it is contemplated herein that the second length 1210 of the tie yarns 1114 is greater than zero (i.e., not all of the tie yarn 1114 is removed). Because of variabilities in the process used remove the first layer 1010 and a portion of the length of the tie yarns 1114 in the second area 1110, it is contemplated that the tie yarns 1114 in the second area 1110 may not comprise all the same length (e.g., second length 1210) but, instead may have an average length that is less than the first length 1036.

Aspects herein contemplate incorporating the textiles described herein (e.g., spacer textiles 100, 700, and/or 1000) in a garment. When incorporated into a garment, it is contemplated that the first areas of the textile (i.e., the areas comprising the first layer, the second layer, and the third layer) may be positioned in areas of the garment needing, for instance, increased cushioning (e.g., pressure areas such as elbow regions, shoulder regions, knee regions, and the like) and/or areas needing increased insulation. The second areas of the textile (i.e., the areas where the first layer and a portion of the length of the tie yarns are absent or removed) would be positioned in areas of the garment corresponding to high heat and/or sweat producing areas of the human body when the garment is worn. Because these areas have a higher air permeability as compared to, for instance, areas of the textile comprising the first layer, the second layer, and the third layer, air from the external environment may more readily enter the garment to help cool the wearer, and heat produced by the wearer may more readily escape the garment further helping to keep the wearer cool.

Figure 13:
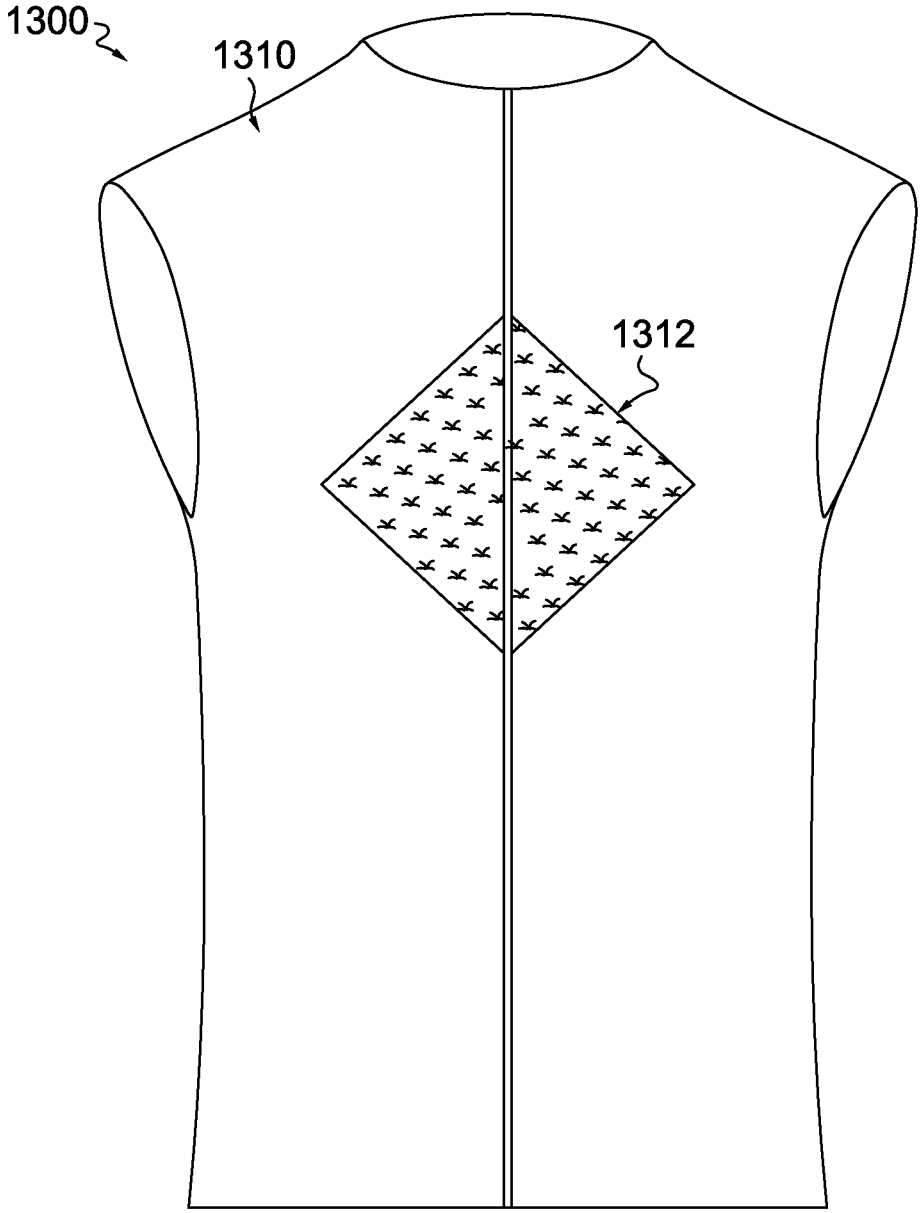
FIG. 13 illustrates a garment incorporating the spacer textile of FIGS. 10-12 in accordance with aspects herein.

A garment 1300 is shown in FIG. 13 in accordance with aspects herein. The garment 1300 is shown in the form of an upper-body garment (e.g., a vest), but it is contemplated herein that the garment 1300 may be in the form of a lower-body garment, a whole body garment, and the like. Moreover, although shown in the form of a vest, it is contemplated herein that the garment 1300 may take other forms such as a jacket, a pull-over, a hoodie, a shirt, and the like. Any and all aspects, and any variation thereof, are contemplated as being within aspects herein. In aspects, the garment 1300 may be entirely formed from one of the spacer textiles described herein. Alternatively, one or more portions of the garment 1300 may be formed from one or more of the spacer textiles described herein and other portions of the garment 1300 may be formed from other textile types (e.g., woven, non-woven, different knit constructions, and the like). To simplify the discussion, the garment 1300 will be described as being formed entirely from the spacer textile 1000. However, as previously discussed, it is contemplated herein that the garment 1300 may also be formed from the spacer textile 100 or the spacer textile 700.

With respect to the garment 1300, in aspects it is contemplated that the first layer 1010 of the spacer textile 1000 may comprise an outer-facing surface 1310 of the garment 1300. The second layer 1012 of the spacer textile 1000 forms an inner-facing surface of the garment 1300 (not shown in FIG. 13). In an alternative aspect (not shown), the first layer 1010 of the spacer textile 1000 may comprise an inner-facing surface of the garment 1300. The second layer 1012 in this aspect would form the outer-facing surface of the garment 1300. Any and all aspects, and any variation thereof, are contemplated as being within aspects herein.

As shown in FIG. 13, the garment 1300 comprises at least one area 1312 from which the first layer 1010 and the loop portion 1032 of the tie yarns 1015 are removed. Although the area 1312 is shown as diamond shaped, it is contemplated herein that the shape of the area 1312 may comprise other shapes such as shapes associated with branding (e.g., logos or images), other geometric shapes, organic shapes, and the like. The area 1312 is positioned on the garment 1300 at a front upper torso portion of the garment 1300. In aspects, this area may correspond to a high heat or sweat producing area of a wearer when the garment 1300 is worn as based on, for example, heat or sweat maps of the human body. The location of the area 1312 on the garment 1300 is illustrative only and it is contemplated herein that the garment 1300 may comprise other areas from which the first layer 1010 and the loop portion 1032 of the tie yarns 1015 are removed (e.g., back torso portion).

Figure 14:
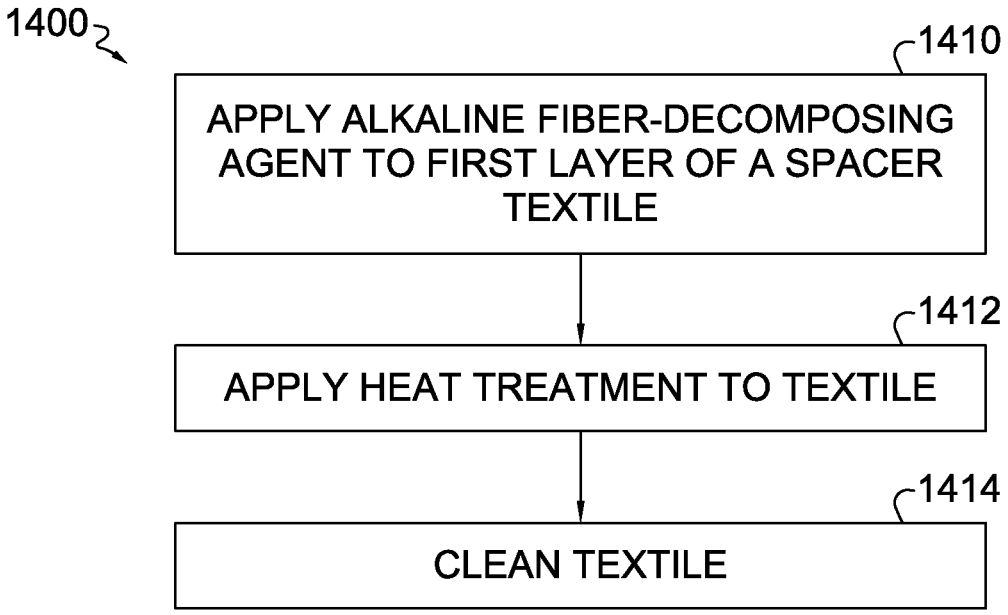
FIG. 14 illustrates a flow diagram of a method of forming a spacer textile as described herein in accordance with aspects herein.

Turning now to FIG. 14, a flow diagram is depicted of a method 1400 of forming a spacer textile such as the spacer textile 100, the spacer textile 700 or the spacer textile 1000 having one or more areas at which the first layer of the spacer textile is removed along with all of the tie yarns (such as spacer textile 700) or a portion of the length of the tie yarns (such as spacer textile 100 or spacer textile 1000). At a step 1410, an alkaline fiber-decomposing agent is applied to a first layer of a spacer textile at one or more discrete areas where the spacer textile comprises the first layer, a second layer, and a third layer, and where the third layer is interknitted with the first layer and the second layer. In aspects the first layer is formed from CD PET yarns, the second layer is formed from non-CD PET yarns (e.g., regular PET yarns, polyamide yarns, elastomeric yarns, cotton yarns, and the like), and the third layer is formed from either monofilament CD PET yarns or multifilament CD PET yarns.

In aspects, the alkaline fiber-decomposing agent may comprise an alkali having a pH of at least 10. Some examples of suitable alkaline fiber-decomposing agents include guanidine weak acid salts, phenols, alcohols, alkali metal hydroxides, and alkaline earth metal hydroxides. It is contemplated herein that the alkaline fiber-decomposing agent be dissolved in water to make it suitable for application. Suitable concentrations may comprise from about 15 wt % to about 30 wt %.

In aspects, the alkaline fiber-decomposing agent may be applied by a digital printing process, a screen printing process, an ink-jet printing process, a roller printing process, and the like. Moreover, parameters associated with the alkaline fiber-decomposing agent may be adjusted during the application process. For instance, the amount of alkaline fiber-decomposing agent applied may be adjusted by utilizing, for example, a two pass or multiple pass printing process as opposed to a single pass. In aspects, the amount of the alkaline fiber-decomposing agent applied may range from about 5 $g/m^2$ to about 30 $g/m^2$.

Continuing, at a step 1412, a heat treatment is applied to the textile to facilitate the removal and/or degradation of the CD PET yarns. In aspects, the temperature may be from about 160° C. to about 190° C., and the textile may be subjected to the increased temperature for about 10 minutes. At a step 1414, the textile is cleaned to remove any residual alkaline fiber-decomposing agent and to remove any decomposed/degraded yarns. One cleaning method is reduction cleaning using hydrosulfite, surfactant, and soda ash.

The method may further comprise incorporating the spacer textile into a garment. In this aspect, the spacer textile is incorporated into a garment such that the areas at which the first layer is removed along with a portion of the length of the tie yarns is positioned on the garment to correspond to high heat or sweat producing areas of the human body when the garment is worn.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. An integral, three-dimensional spacer textile comprising:

a first area comprising a first layer having a mesh construction with a plurality of integrally formed holes, the first layer having at least a first outer surface defining a first outer surface plane, a second layer having at least a second inner surface, and a third layer, the third layer comprising a first multifilament tie yarn of a first plurality of multifilament tie yarns that interconnect the first layer and the second layer, the first multifilament tie yarn having a first length in the first area as measured between the second inner surface and the first outer surface plane; and a second area comprising the second layer and at least a second multifilament tie yarn of a second plurality of multifilament tie yarns in the third layer, the second multifilament tie yarn including a distal terminal end, wherein the second multifilament tie yarn comprises a second length as measured between the second inner surface and the distal terminal end of the second multifilament tie yarn in a direction extending toward the first outer surface plane, the second length less than the first length.

2. The integral, three-dimensional spacer textile of claim 1, wherein the first layer comprises a knit construction, and wherein the second layer comprises a continuous knit construction.

3. The integral, three-dimensional spacer textile of claim 2, wherein the first layer, the second layer, and the third layer are interknitted in the first area.

4. The integral, three-dimensional spacer textile of claim 1, wherein the first layer comprises a first yarn type comprising a cationic dyeable polyethylene terephthalate (CD PET).

5. The integral, three-dimensional spacer textile of claim 1, wherein each of the first plurality of multifilament tie yarns and each of the second plurality of multifilament tie yarns comprise a third yarn type, the third yarn type comprising a cationic dyeable polyethylene terephthalate (CD PET).

6. The integral, three-dimensional spacer textile of claim 5, wherein the each of the first plurality of multifilament tie yarns and the each of the second plurality of multifilament tie yarns comprise a denier of about 20 denier.

7. The integral, three-dimensional spacer textile of claim 1, wherein the second layer comprises one or more polyamide yarns and one or more elastomeric yarns.

8. The integral, three-dimensional spacer textile of claim 7, wherein each of the one or more elastomeric yarns is wrapped with a polyamide yarn.

9. The integral, three-dimensional spacer textile of claim 1, wherein the second area further comprises a third multifilament tie yarn of the second plurality of multifilament tie yarns in the third layer, the third multifilament tie yarn including a distal terminal end, wherein the third multifilament tie yarn comprises a third length as measured between the second inner surface and the distal terminal end of the third multifilament tie yarn in a direction extending toward the first outer surface plane, the third length less than the second length.

10. A garment comprising:

an integral, three-dimensional spacer textile comprising:

a first area having a first layer having a mesh construction, the first layer having at least a first outer surface defining a first outer surface plane, a second layer having at least a second inner surface, and a third layer, the third layer comprising a first multifilament tie yarn of a first plurality of multifilament tie yarns that interconnect the first layer and the second layer, the first multifilament tie yarn having a first length in the first area as measured between the second inner surface and the first outer surface plane; and a second area comprising the second layer and a second multifilament tie yarn of a second plurality of multifilament tie yarns in the third layer, the second multifilament tie yarn including a distal terminal end, wherein the second multifilament tie yarn comprises at least a second length as measured between the second inner surface and the distal terminal end of the second multifilament tie yarn in a direction extending toward the first outer surface plane, the second length less than the first length.

11. The garment of claim 10, wherein the first layer comprises an outer-facing surface of the garment, and wherein the second layer comprises an inner-facing surface of the garment.

12. The garment of claim 10, wherein the first layer comprises an inner-facing surface of the garment, and wherein the second layer comprises an outer-facing surface of the garment.

13. The garment of claim 10, wherein the second area is positioned on the garment so as to be positioned adjacent to high heat-producing areas of a human body based on heat maps of the human body when the garment is in an as-worn configuration.

14. The garment of claim 13, wherein the first area is positioned on the garment so as to be positioned adjacent to low heat-producing areas of the human body based on heat maps of the human body when the garment is in the as-worn configuration.

15. The garment of claim 10, wherein the first layer, the second layer, and the third layer are interknitted in the first area.

16. An integral, three-dimensional spacer textile comprising:

a first area comprising a first layer having a continuous knit construction, the first layer having at least a first outer surface defining a first outer surface plane, a second layer having at least a second inner surface, and a third layer, the third layer comprising a first multifilament tie yarn of a first plurality of multifilament tie yarns that interconnect the first layer and the second layer, the first multifilament tie yarn having a first length in the first area as measured between the second inner surface and the first outer surface plane; and a second area comprising the second layer and a second multifilament tie yarn of a second plurality of multifilament tie yarns in the third layer, the second multifilament tie yarn including a distal terminal end, wherein the second multifilament tie yarn comprises a second length as measured between the second inner surface and the distal terminal end of the second multifilament tie yarn in a direction extending toward the first outer surface plane, the second length less than the first length.

17. The spacer textile of claim 16, wherein the second layer comprises a continuous knit construction.

18. The spacer textile of claim 17, wherein the first layer, the second layer, and the third layer are interknitted in the first area.

19. The spacer textile of claim 16, wherein the first layer is formed from a first yarn type comprising a cationic dyeable polyethylene terephthalate (CD PET).

20. The spacer textile of claim 19, wherein the first yarn type comprises a denier from about 20 denier to about 24 denier.

* * * * *